United States Patent [19]

Cosmos et al.

[11] Patent Number: 4,908,335

[45] Date of Patent: Mar. 13, 1990

[54] ONE-PIECE MOLDED INSULATING HOUSING FOR A CIRCULAR DIN CONNECTOR

[75] Inventors: Pete Cosmos, Mechanicsburg; Benjamin H. Mosser, III, Middletown; William C. Ohl, Harrisburg, all of Pa.

[73] Assignee: AMP Incorporated, Harrisburg, Pa.

[21] Appl. No.: 379,653

[22] Filed: Jul. 11, 1989

Related U.S. Application Data

[63] Continuation of Ser. No. 202,727, Jun. 3, 1988, abandoned.

[51] Int. Cl.[4] ..... H01R 9/09

[52] U.S. Cl. ..... 439/79; 439/609; 439/444

[58] Field of Search ..... 439/78, 79, 80, 83, 439/607, 608, 609, 629, 676, 444

[56] References Cited

U.S. PATENT DOCUMENTS

| | | | |
|---|---|---|---|
| 4,292,736 | 10/1981 | Hughes et al. | 29/884 |
| 4,337,989 | 7/1982 | Asick | 339/143 |
| 4,493,525 | 1/1985 | Hall | 339/143 |
| 4,611,878 | 9/1986 | Hall | 339/186 |
| 4,634,208 | 1/1987 | Hall | 339/143 |
| 4,637,669 | 1/1987 | Tajima | 339/14 |
| 4,660,911 | 4/1987 | Reynolds et al. | 439/80 |
| 4,679,879 | 7/1987 | Triner et al. | 439/607 |
| 4,695,105 | 9/1987 | Ney | 439/95 |
| 4,697,864 | 10/1987 | Hayes et al. | 439/444 |
| 4,721,472 | 1/1988 | Gentry et al. | 439/79 |
| 4,721,473 | 1/1988 | Delguidice et al. | 439/79 |
| 4,789,346 | 12/1988 | Frantz | 439/80 |

FOREIGN PATENT DOCUMENTS 0228194 2/1986 European Pat. Off. .

OTHER PUBLICATIONS

Cover sheet, inside cover sheet and p. 78 of Positronic Inds. Inc. Pamphlet.

AMP Catalog 83-700, Rev. 10-1986.

*Primary Examiner*—Neil Abrams

*Assistant Examiner*—Khiem Nguyen

*Attorney, Agent, or Firm*—David L. Smith

[57] ABSTRACT

A one piece, molded, insulating connector body (14) for a surface mounted, shielded, electrical connector (10), comprises a plug portion (16) projecting from the body (14) into a forward hood (68) thereto, for mating with a shielded electrical socket (18) inserted into the hood (68). There projects from a terminal receiving face (70) of the body (14), a terminal leg spacer plate (74) having notches for receiving the 'U'-shaped retaining members (108) on the legs (100) of the terminals (95) in through cavities (62) in the body (14). Each leg (100) has a lance (112) for insertion in a hole (H) in a substrate (S). The legs (100), and cranked arms (102) connecting them to receptacles (96) of terminals (95), are so shaped and dimensioned that even where the cavities (62) are arranged in three superposed rows, the lances (112) can be inserted into the holes (H) where these are arranged in only two rows, and with a different spacing from that of the rows of cavities.

17 Claims, 8 Drawing Sheets

A
12
14
10
S
AP
AP1
H

ONE-PIECE MOLDED INSULATING HOUSING FOR A CIRCULAR DIN CONNECTOR

This application is a continuation of application Ser. No. 202,727 filed June 3, 1988, now abandoned.

FIELD OF THE INVENTION

This invention relates to an insulating housing for a surface mounted, shielded electrical connector comprising a circular cross-section elongate, plug portion for mating with a circular cross-section electrical socket and having at one end thereof a mating face, a plurality of terminal receiving, parallel cavities, extending through the plug portion axially thereof and each having a pin receiving mouth opening into the mating face, and a substantially rectangular cross-section connector body connected to the plug portion, having a terminal receiving face opposite to said mating face, each of the cavities extending through said body and opening into the terminal receiving face.

BACKGROUND OF THE INVENTION

Such a housing, which is for a connector which is generally known as a 'Miniature Circular DIN Type Connector', is disclosed in U.S. Pat. No. 4,637,669. The body, which is made of a plurality of separate parts, serves to locate and guide between these parts the connecting legs of terminals in the cavities, which legs project from a bottom, mounting face, of the housing for insertion in holes in a substrate, for example a printed circuit board. Although there is disclosed in U.S. Pat. No. 4,493,525, a one part, molded insulating housing for a surface mounted electrical connector, of the kind under discussion, having a front shield, the terminal legs are held in position, only by virtue of means for retaining mating parts of the terminals in the cavities.

SUMMARY OF THE INVENTION

The present invention is intended to provide a housing of the kind outlined above, which can readily be molded in one piece, preferably by the use of straight action core pins, and in which the terminal legs are firmly and accurately positioned for insertion in the holes in the substrate.

According to the invention, the connector body which has been molded in one piece, with the plug portion, has a forwardly projecting hood surrounding the plug portion in spaced relationship therewith to allow the socket portion to be mated with the plug portion, said body having a terminal receiving face opposite to said mating face and each of said cavities extending through said body and having a terminal receiving mouth opening into said terminal receiving face. For properly locating the legs of the terminals, a terminal leg spacer plate formed integrally with said body projects from the terminal receiving face along one edge thereof in a direction away from said plug portion, a plurality of elongate, terminal leg receiving notches each extending normally of the terminal receiving face, opening into an edge of the spacer plate remote from that face, each for the retention of a terminal leg therein.

Where the cavities comprise a plurality of superposed rows, each of the notches is shaped for the retention of a plurality of terminal legs therein in spaced relationship lengthwise of the notch. Each notch may have a wider portion for receiving one of these terminal legs and a narrower portion, for receiving another of the terminal legs.

For the purpose of protecting the terminal legs, a protective skirt may be provided on said terminal receiving face to extend rearwardly thereof. The forwardly projecting hood, the said body and the protective skirt, may be formed with external grooves each opening into a forward edge of the hood and a rear edge of the protective skirt for slidably receiving a flange on a metal shield for the housing for anchoring the shield thereto. Side walls of the protective skirt may also be formed with notches for receiving detents on the shield, better to anchor the shield to the housing.

Each of said grooves preferably has a deepened portion opening into the rear edge of the protective skirt so that a flange can be engaged in the deepened portion with a snap action, as the shield is slid home over the body.

The invention also relates to the one piece molded housing and the terminals, in combination.

The legs of the terminals, may be provided with retaining means in the form of substantially 'U' shaped members projecting from the legs, for reception in the notches, to retain the legs therein, tips of the 'U' shaped members preferably being provided with skiving wings for biting into the walls of the notches.

The cavities may, for example be arranged in three rows displaced from each other in a direction perpendicular to the mounting face, and the legs of the terminals being so connected to mating portions thereof and the lengths of the legs being such that the legs can be inserted into holes in the substrate which are arranged in only two rows.

The housing can readily be molded in one piece by the use of only straight acting core pins.

DETAILED DESCRIPTION OF THE INVENTION

For a better understanding of the invention, reference will now be made by way of example to the accompanying drawings in which.

Figure 1:
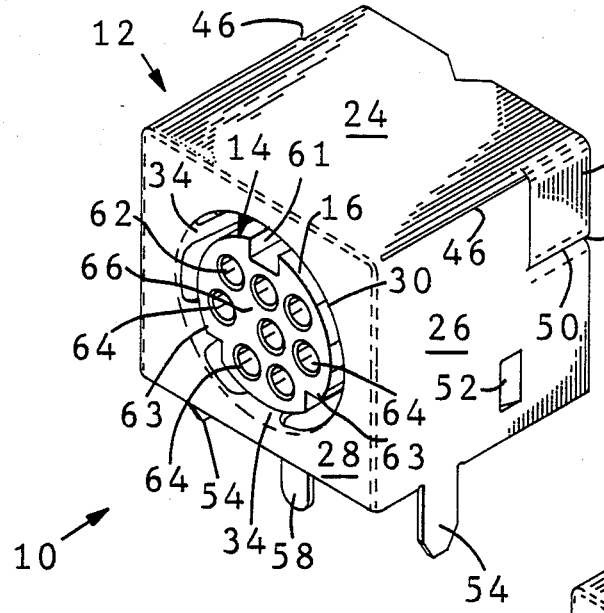
FIG. 1 is a fragmentary isometric view of a shielded, surface mounted eight position electrical connector.
Figures 1A, 2, 3:
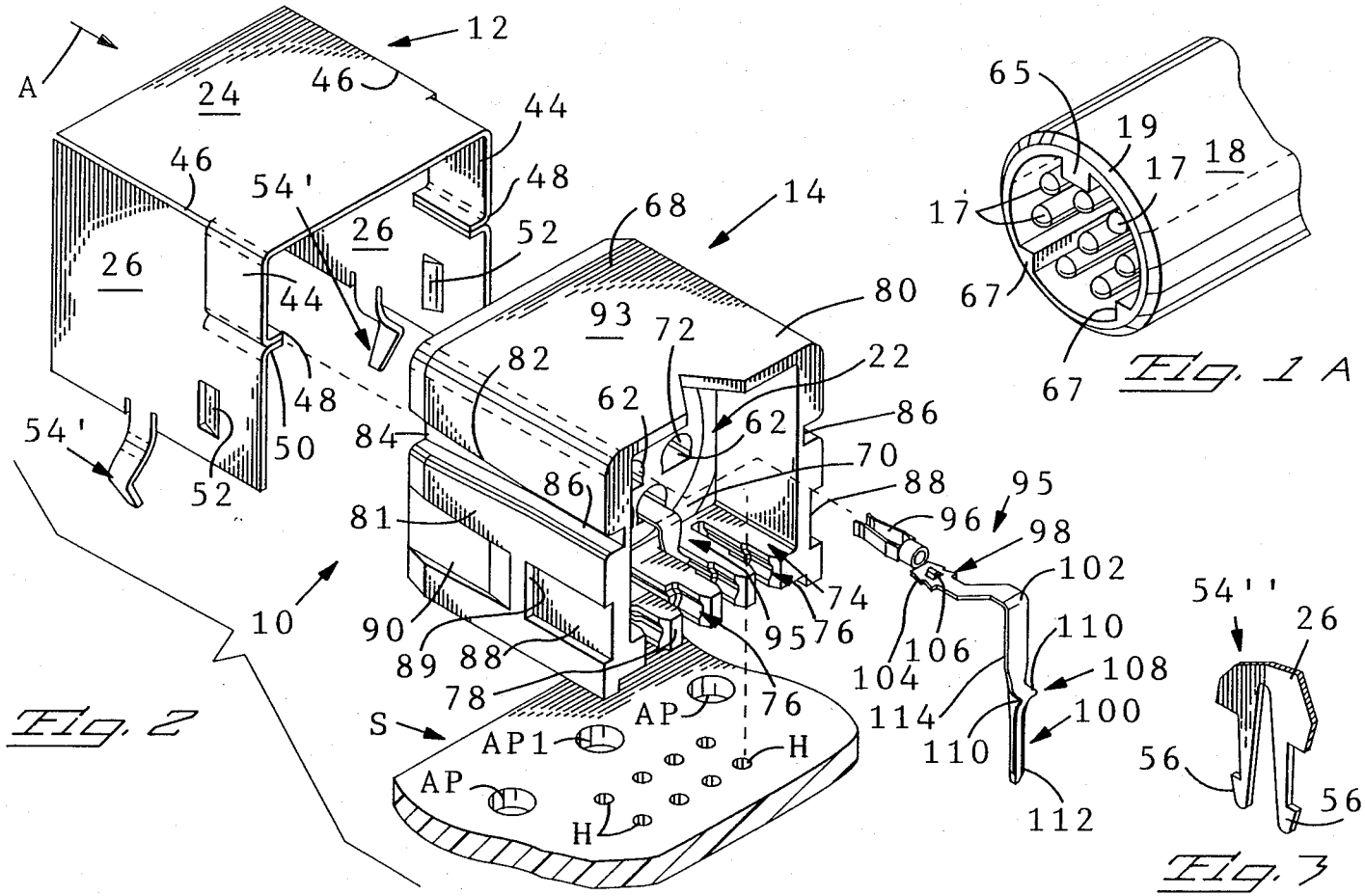
FIG. 1A is a fragmentary isometric view of a shielded electrical socket.
FIG. 2 is an isometric, partly diagramatic exploded view of a modified version of the connector.
FIG. 3 is a fragmentary isometric view illustrating a modification of the mounting feet of the connector of FIG. 2.

As shown in FIGS. 1 and 2, a shielded electrical connector for mounting on a substrate, for example a printed circuit board, comprises a one piece metal shield 12 and a substantially rectangular cross-section, one piece, molded, insulating connector body 14. There projects from the connector body 14, forwardly, a circular cross-section plug portion 16 for mating with a circular cross-section externally shielded electrical socket 18 (FIG. 1A) having a metal shield 19, and into which project electrical pins 17.

Figure 11:
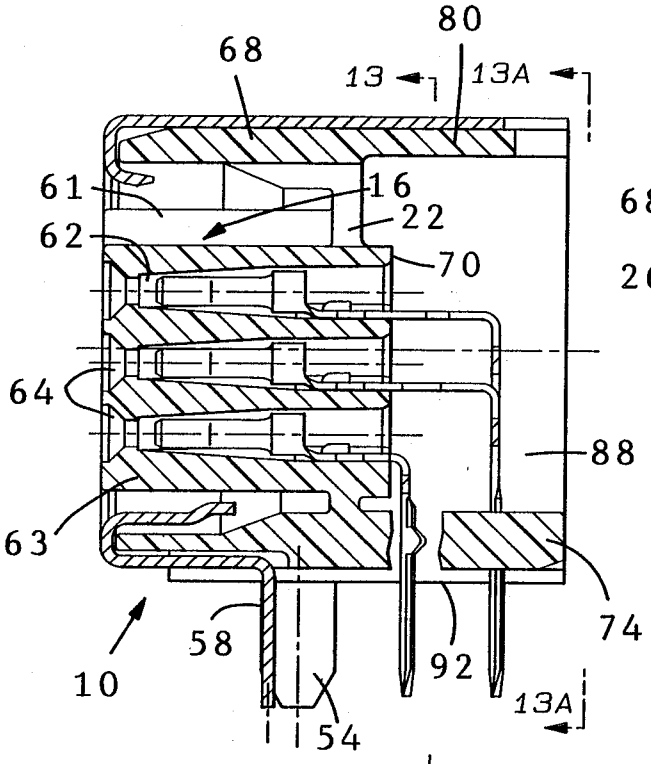
FIG. 11 is an axial actual sectional view of the shielded connector of FIG. 1.

As best see in FIG. 11, the body 14 has a central portion 22 from which the plug portion 16 projects.

Figure 4:
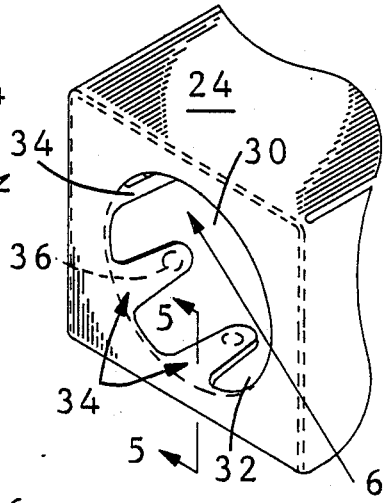
FIG. 4 is a fragmentary isometric view of a part of the metal shield of the connector of FIG. 1.
Figure 6:
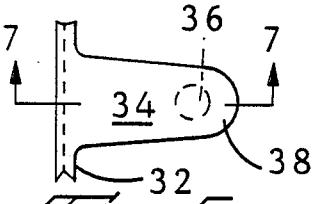
FIG. 6 is a fragmentary view taken in the direction of the arrow 6 in FIG. 4.
Figure 7:
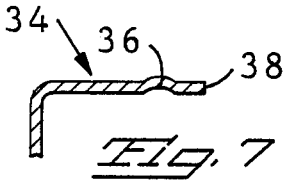
FIG. 7 is a view taken on the lines 7—7 of FIG. 6.

The shield 12 comprises a top wall 24, a pair of side walls 26, each adjacent to the top wall 24 and depending from opposite lateral edges thereof. A front wall 28 adjacent to the top wall 24 and the side walls 26, is formed integrally therewith and has a circular, through opening 30 therein, for receiving the socket 18. The opening 30 has a circular edge 32 from which project a series of resilient cantilever fingers 34 on the shield 12, rearwardly thereof, for engaging the external shielding 19 of the socket 18, the fingers 34 being constantly spaced from one another about the edge 32. Fingers 34 are formed from the portion of surface 28 that otherwise would enclose opening 30. As shown in FIGS. 4, 6 and 7, each finger 34 has formed therein an embossment 36 proximate to, but spaced back from, its free end 38 and projecting in the radially inward direction of the opening 30 in order to limit free deflection of the fingers 34 by the socket portion 18 as it is being mated with the plug portion 16, so that the shield 19 of the latter engages the embossments 36 and does not overstress the fingers 34.

Figure 8:
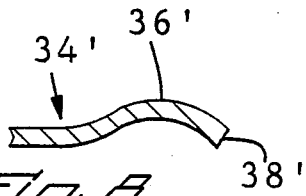
FIGS. 8 and 9 are a longitudinal sectional view and an isometric view, respectively, illustrating a modification of the part shown in FIGS. 6 and 7.
Figure 9:
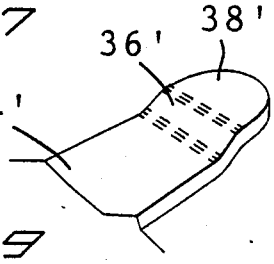

According to the modification shown in FIGS. 8 and 9, in which the finger is referenced 34′ and the embossment, 36′, the embossment 36′ is formed at the end of the finger 34′.

Figure 5:
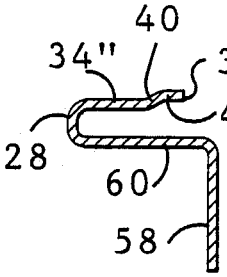
FIG. 5 is a view taken of the lines 5—5 of FIG. 4.

According to the modification shown in FIG. 5, the finger, which is referenced 34″ is formed with a joggle 40 spaced back from its free end 38″ to provide a raised shoulder 42 for engaging the shield 19.

Figure 13A:
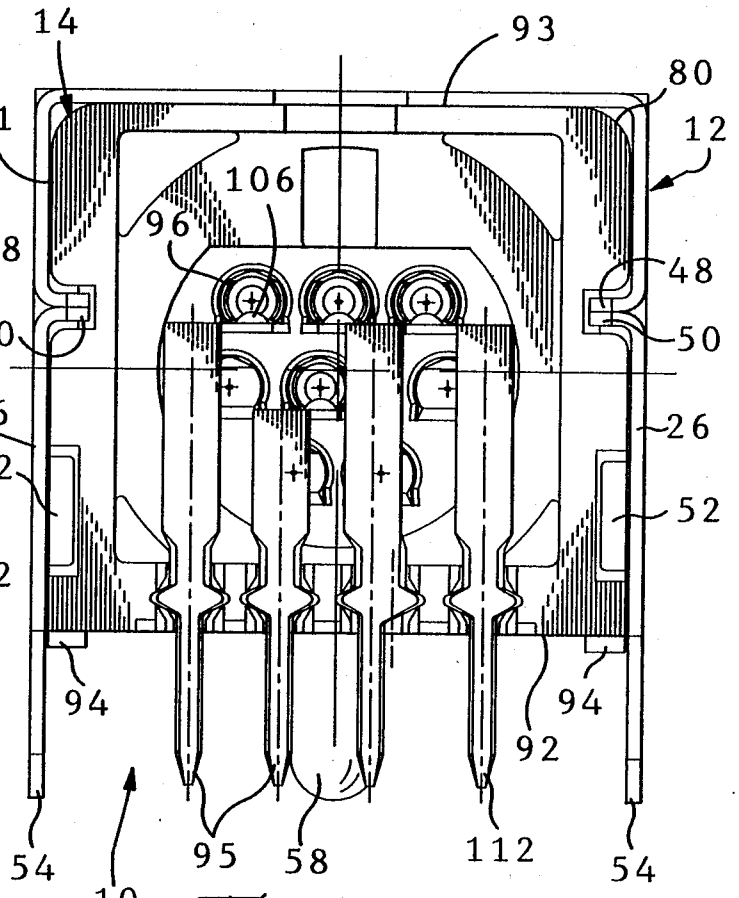
FIG. 13A is a rear view of the connector of FIG. 2 having the terminals in the rearward substrate row secured therein.
Figure 13:
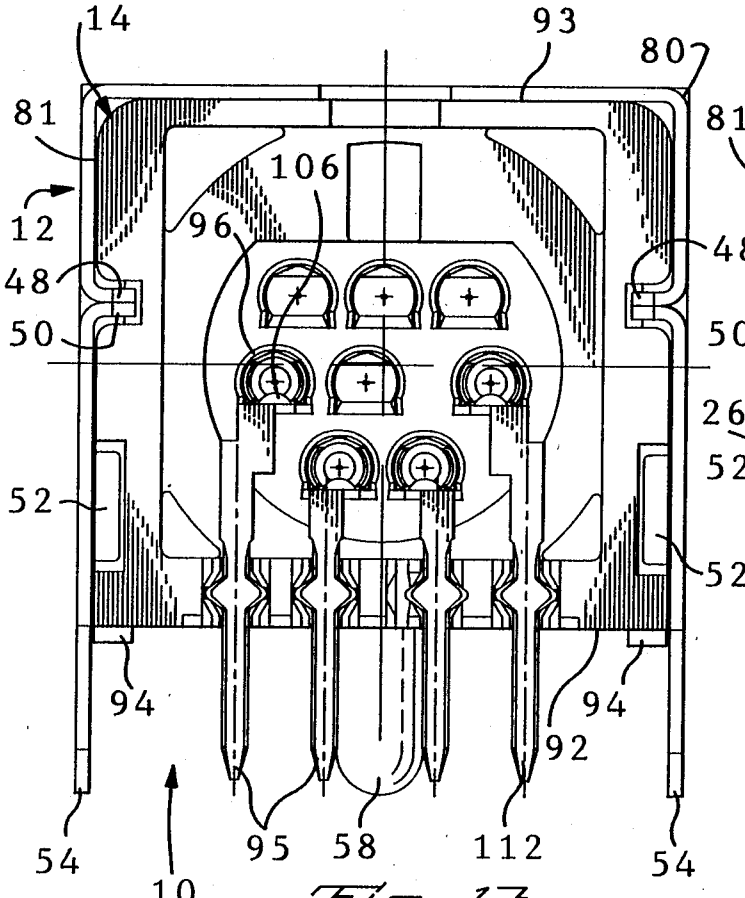
FIG. 13 is a fragmentary rear view of the connector of FIG. 1 having the terminals in the forward substrate row of holes secured therein.
Figure 14:
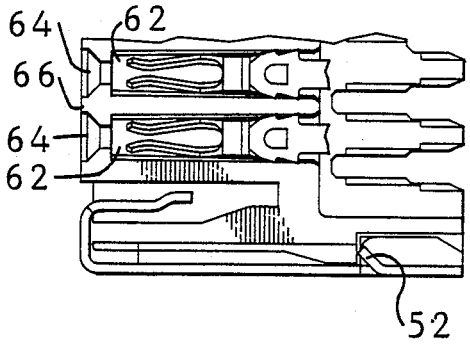
FIG. 14 is a fragmentary horizontal sectional view of the connector of FIG. 1.
Figure 15:
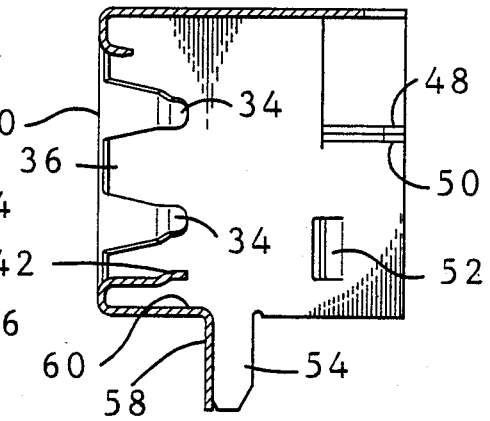
FIG. 15 is an axial sectional view of the shield of the connector of FIG. 1.

There depend from opposite lateral edges 46 of the top wall 24 at its rear end, that is to say at its end remote from the front wall 28, tabs 44, each tab 44 terminating in a flange 48, the flanges 48 projecting towards each other, that is to say inwardly of the shield 12. Just below (as seen in FIGS. 2 and 13, as well as in FIG. 15), each flange 48 the respective side wall 26 is formed with a further inturned flange 50, extending parallel to, and being contiguous with, the flange 48 thereabove. Below the flange 50, each side wall 26 has struck out therefrom, a detent 52 in the form of a resilient tongue projecting obliquely interiorly of the shield 12 proximate to its rear end.

Figure 10:
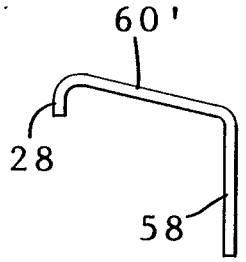
FIG. 10 is a similar view to that of FIG. 5 but illustrating a modification of the parts shown therein.

The shield 12 is further provided with means for securing it to the substrate S, in the form of mounting feet 54 (FIGS. 1, 11, 13, and 15), 54′ (FIG. 2), or 54″ (FIG. 3) depending from the respective side walls 26. The mounting feet 54 are in the form of a simple tab, the mounting feet 54′ being in the form of claws which are bowed in opposite directions, outwardly of the shield 12, the mounting feet 54″ being bifurcated and thus comprising two portions, each portion terminating in a barb 56 and said portions being resiliently deflectable towards each other. The front wall 28 is provided with a further mounting foot 58 depending from a rearward extension 60 of the front wall 28 extending parallel to the top wall 24 or, as shown in FIG. 10, an extension 60′ of the front wall 28 extending obliquely downwardly therefrom. Said extensions may be said to constitute rudimentary bottom walls of the shield 12.

The plug portion 16 is formed with terminal receiving, parallel cavities 62 extending therethrough, axially thereof and each having a pin receiving flared mouth 64 opening into a mating face 66 body of the plug portion 16. The central portion 22 has projecting forwardly therefrom a hood 68 surrounding the plug portion 16 n spaced relationship thereto, to allow the socket 18 to be mated with the plug portion 16. The portion 22 of the housing 14 has a terminal receiving face 70 opposite to the mating face 66, each cavity 62 extending through the portion 22 and having a terminal receiving mouth 72 opening into the face 70.

The plug portion 16 has axial keyways 61 and 63 for the reception of complementary keys 65 and 67 in the socket 18.

A terminal leg spacer plate 74 extending along the lower edge of the face 70, in a direction away from the plug portion 16 is formed with a plurality of elongate, in the axial direction of the cavities 62, terminal leg receiving spacer notches 76 each extending normally of the face 70 and opening into the rear edge 78 of the spacer plate 74, remote from the face 70, each notch 76 being shaped for the retention two terminal legs therein, to correspond to the two rows of terminal leg receiving apertures in the footprint of the connector.

Notches 76 in spacer plate 74 define sidewalls 75. V-shaped grooves 77 in sidewalls 75 receive lugs 110, which are preferably pointed as shown in FIG. 13 or 13A, skive sidewalls 75 upon insertion and prevent withdrawal of legs 100 from notches 76. Lugs 110 not only secure leg 100 in notch 76 but also prevent leg 100 from moving normal to spacer plate 74. The notches 76 in spacer plate 74 are offset toward a side wall 81 relative to the respective terminal receiving cavity 62 in plug portion 16.

Figure 12:
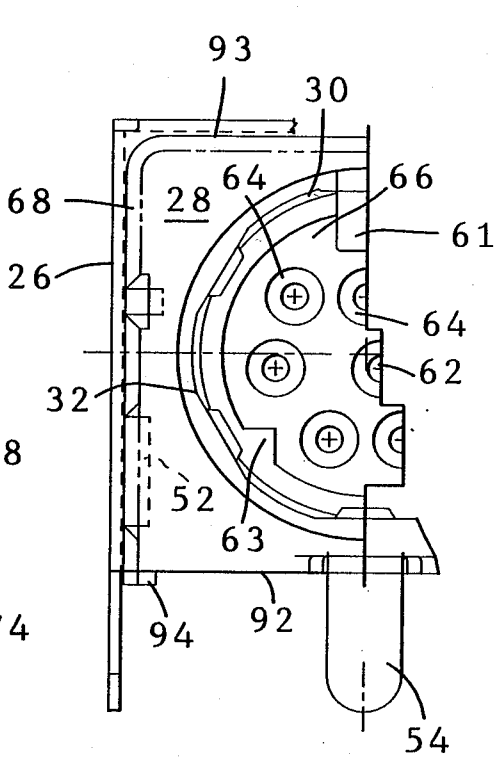
FIG. 12 is a fragmentary front view of the shielded connector of FIG. 1.

A protective skirt 80 projects from the face 70 of the portion 22, rearwardly from the periphery thereof and adjoins each end of the spacer plate 74. The hood 68, the portion 22, and the skirt 80 are formed on each side wall 81 of the body 14 with a common external groove 82 opening into the forward edge of the hood 68 and the rear edge of the skirt 80, each groove 82 having a flared flange receiving mouth 84 opening into the forward edge of the skirt 68 and a deepened portion 86 opening into the rear edge 78 of the skirt 80. Each side of the skirt 80 is formed with a recess 88 opening into the rear edge of the skirt 80 below the groove portion 86, defining shield retaining shoulder 89. The hood 68 is formed on either side thereof with an external relief recess 90 opening into the forward edge of hood 68. The body 14 has a bottom mounting face 92 opposite to its top wall 93, provided with stand offs 94 as shown in FIGS. 11 to 13, the face 92 being parallel to the plate 74.

Electrical terminals 95 each for reception in a respective cavity 62 each comprise a forward, mating part in the form of a receptacle 96, an intermediate insertion and retention part 98 connected to the rear end of receptacle 96 and a terminal leg 100 connected to the rear end of the part 98 by way of an arm 102, the leg 100 extending at right angles to the remainder of the terminal 95. Cranked arm 102 of each terminal 95 makes the transition between the forward mating part in the form of receptacle 96, which is received in a terminal receiving cavity 62, and leg 100, which is received in a respective notch 76. The receptacle 96 is formed in accordance with U.S. Pat. No. 4,776,651, and the insertion and retention part 98 which comprises a laterally barbed retention plate 104 and an insertion hump 106 is formed in accordance with U.S. Pat. No. 4,775,336, both of which patents are incorporated herein by reference. The leg 100 is provided with retaining means in the form of a substantially U-shaped retaining member 108 presenting retention lugs 110, shown in outline in FIG. 2. Each leg 100 has an insertion lance 112 below the member 108 and a leg portion 114 between the member 108 and the part 98. A rear view of the terminals 95 in body 14 is shown in FIGS. 13 and 13A.

In order to assemble the shield 12 to the connector body 14, the terminals 95 having been inserted into the cavities 62 with the forward ends of the receptacles 96 thereof proximate to the mouths 62 and their legs 100 retained in the notches 76 by means of the retaining members 108, the shield 12 is slid onto the connector body 14 in the direction of the arrow A in FIG. 2. During this operation, the flanges 48 and 50 enter respective grooves 82, guided by their flared mouths 84, and finally snap into the deepened portions 86 of the grooves 84, the detents 52 likewise snap into the recesses 88, an edge thereof engaging retaining shoulder 89. The shield is thereby firmly secured to the body 14.

The lances 112 which protrude below the mounting face 92 are then inserted into respective holes H in the substrate S, the mounting feet 54, 54' or 54", as the case may be, entering respective apertures AP in the substrate S, and the mounting foot 58 entering an aperture AP1 in the substrate S. The mounting feet 54 and 58 simply wedge in their respective apertures. The mounting feet 54', however, are resiliently depressed inwardly of the shield 12 by the edges of the apertures AP, being accommodated by the recesses 90, and finally resile, to engage against the lower surface of the substrate S. The two portions of each mounting foot 54" are compressed towards each other by the edge of the respective aperture AP and finally resile, so that the barbs 56 engage against the lower surface of the substrate S.

Figure 15A:
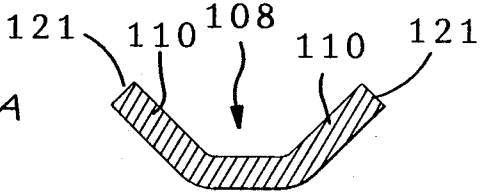
FIG. 15A is a cross-section through a retaining member of an electrical terminal shown in FIG. 2.

Preferably, as shown in FIG. 15A, the lugs 110 of each retaining member 108 have sharp edged skiving wings 121 projecting therefrom for biting into the walls of the respective notch 76. Lugs 110 are preferably pointed as shown in FIG. 13 or 13A with lugs 110 complementary to and received in grooves 77 in sidewalls 75.

Figure 17:
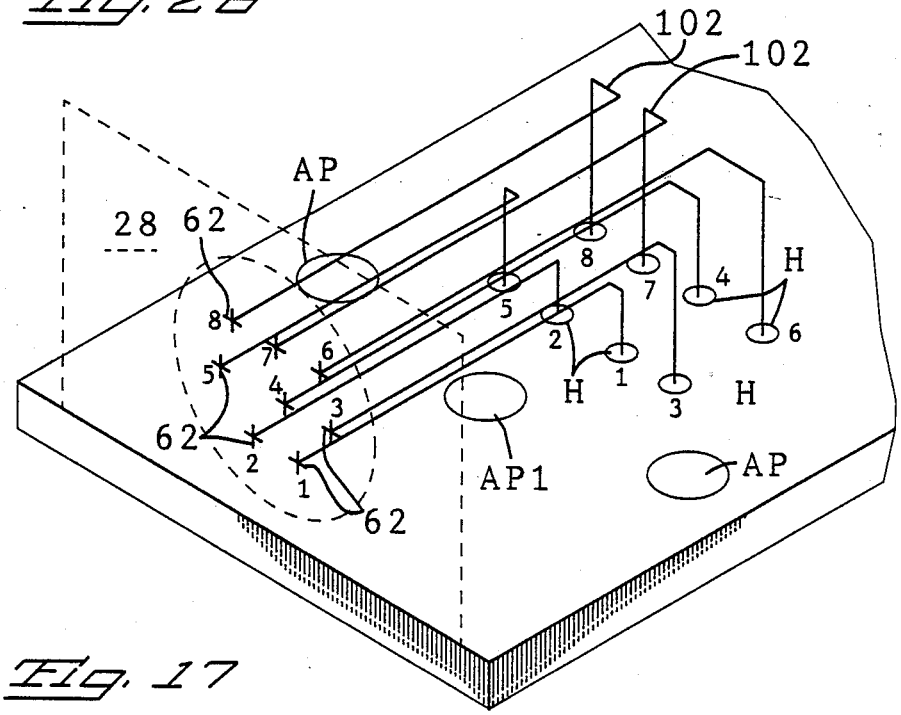
FIG. 17 is a diagram illustrating the general configuration of electrical terminals of an eight position connector to enable legs of the terminals to be received in cavities provided in a substrate in two rows.
Figure 16:
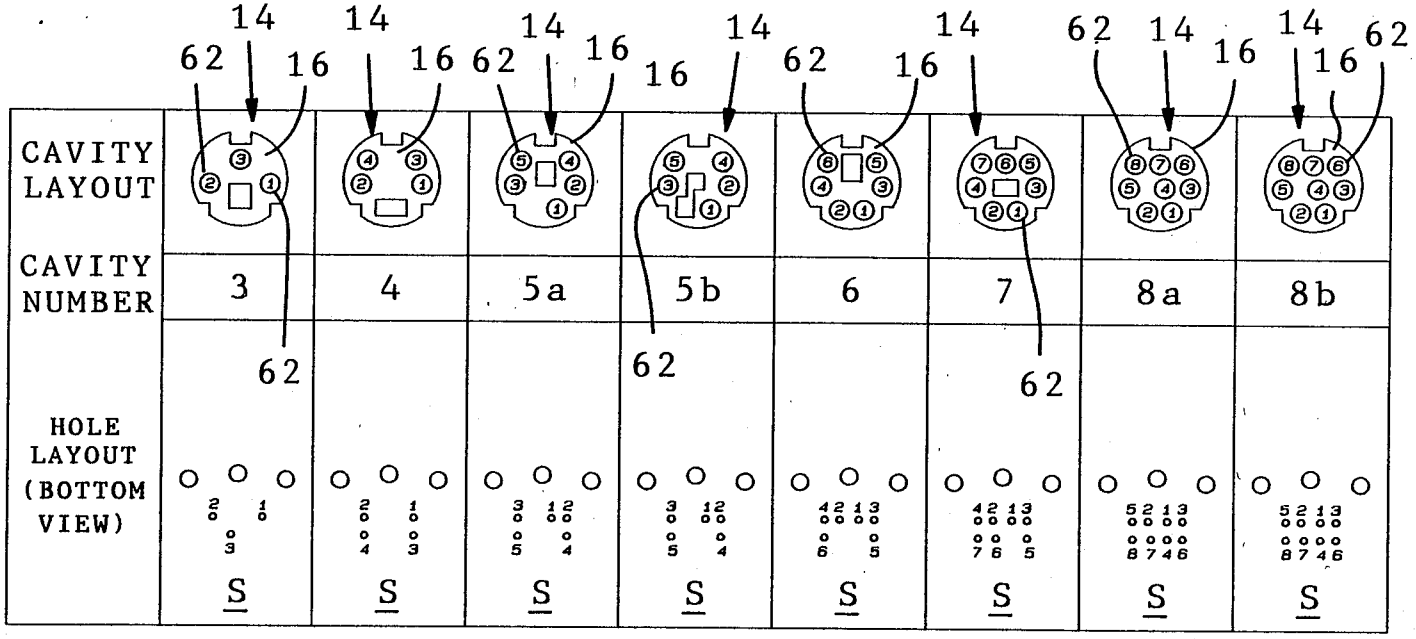
FIG. 16 is a diagram illustrating the arrangement of electrical terminal receiving cavities in respective modifications of the connectors and the arrangement of holes in a substrate upon which connectors according to said modification are to be mounted.

As illustrated in FIG. 16, the body 14 may have different numbers of terminal receiving cavities 62 and differently arranged keyways. The cavities 62 may be arranged at two or three levels displaced from one another in a direction perpendicular to the mounting face 92, although the holes H in the substrate S are, in each case, arranged in two rows only. This means that the lengths of the legs 100 and the configuration of the arms 102 must be adapted both to the layout of the cavities 62 and to that of the holes H. The insertion lances 112 of all the terminals 95 must, of course, all be of the same length. In FIG. 16 the cavities 62 are numbered 1 to 3, 1 to 4 and so on up to 1 to 8, and the holes H are correspondingly numbered. Where there are, for example, eight cavities disposed in three rows (see 8*a* and 8*b* in FIG. 16), the configuration of the arm 102 and the leg portion 114 must be different in respect of each terminal 94. That is to say since the holes 2 are arranged in only two rows, and since the cavities are differently spaced from the spacer plate 74, the arm 102 and leg 100 of each terminal must be dimensioned to compensate for such mis-matching. As shown diagrammatically in FIG. 17, in which the cavities are numbered 1 to 8 and holes are also numbered 1 to 8, the terminals 95 are arranged in four pairs, namely those for the cavities 1 and 2, the cavities 3 and 5, the cavities 4 and 7, and the cavities 6 and 8 respectively, the terminals 95 of each pair being configured so that their arms 102 are cranked in mirror image relationship with one another, that is to say the arms 102 of each pair of terminals 95 offset the legs 100 of the pair in opposite sense with respect to the receptacles 96 thereof.

Figure 18:
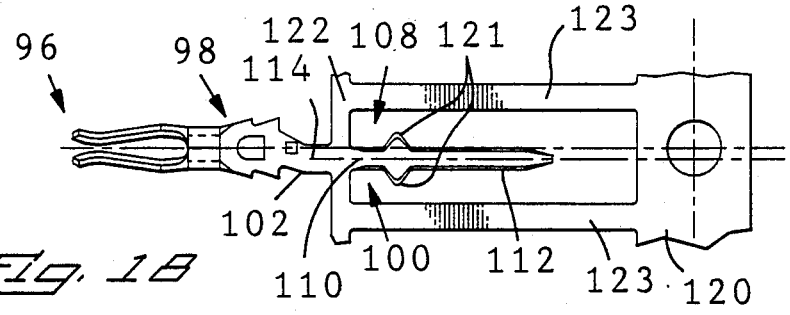
FIGS. 18 to 25 are views of respective electrical terminals.
Figure 19:
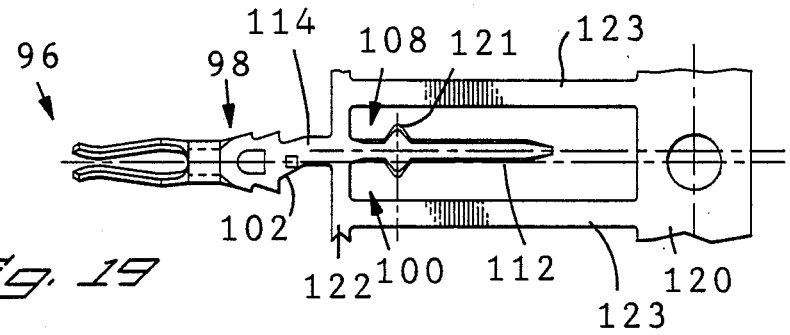
Figure 20:
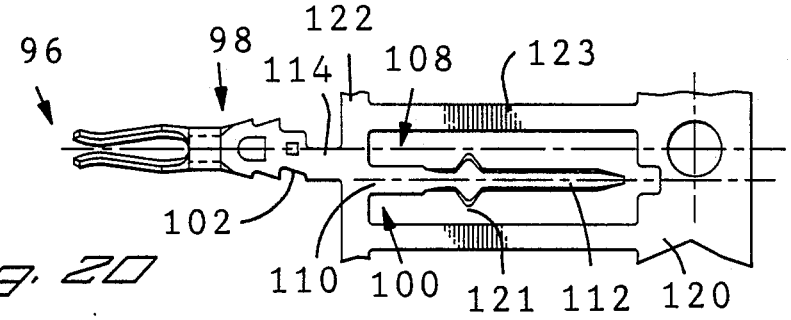
Figure 21:
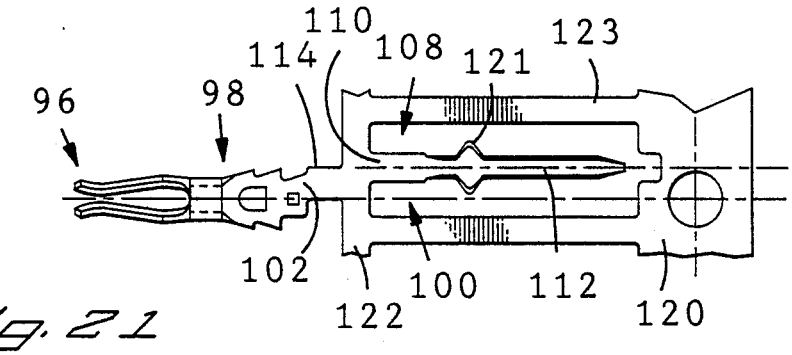
Figure 22:
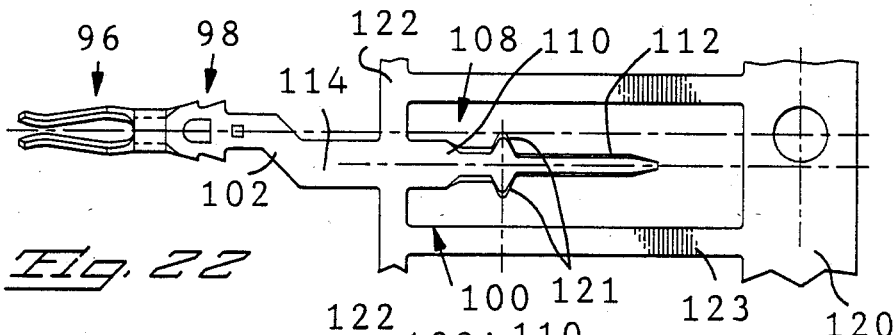
Figure 23:
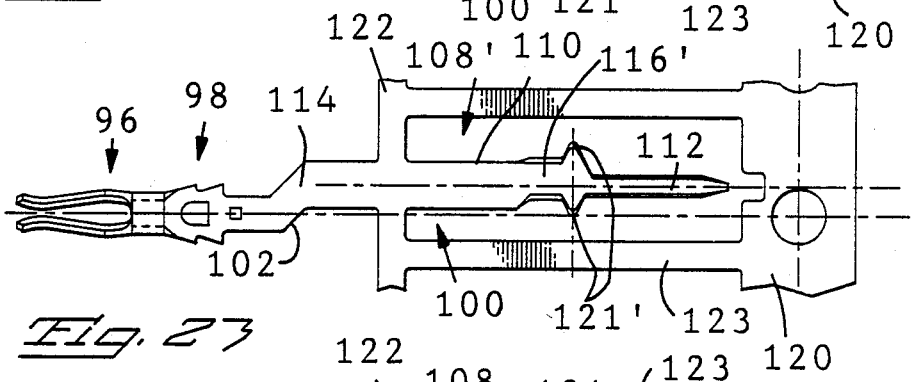
Figure 24:
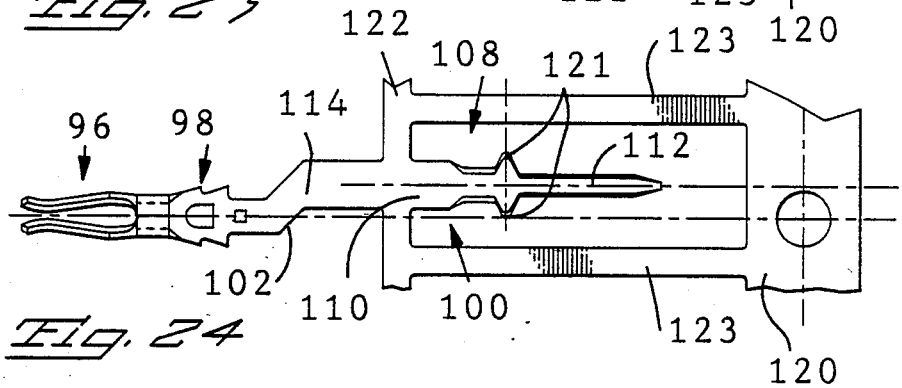
Figure 25:
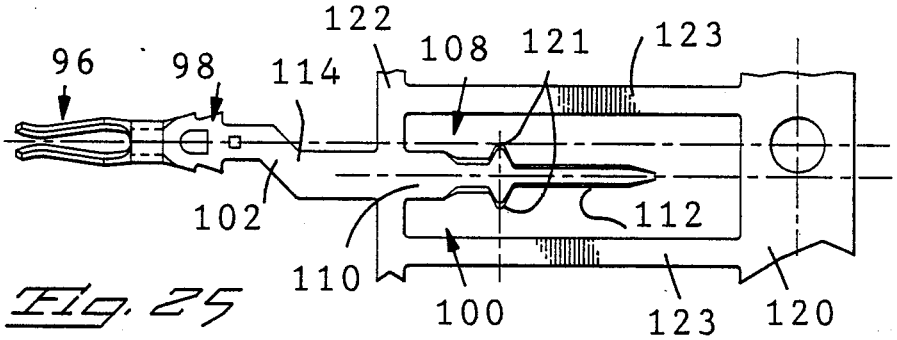

FIGS. 18 to 25, in which the parts are referenced in the same way as the terminal parts in FIG. 2 show, in fragmentary plan view, strips of the respective pairs of terminals 95. FIGS. 18 and 19 show the terminals for the cavities 1 and 2, in the bottom row, in which the arms 102 are oppositely directed to the same extent and the leg portions 114 are the shortest. As shown in FIGS. 20 and 21, the leg portions 114 are longer than those of FIGS. 18 and 19 because both of the terminals of these Figures are in the second row up from the plate 74, i.e, the middle row. The arms 102 in FIGS. 18 and 19 and in FIGS. 20 and 21 offset the legs 100 from receptacles 96 to substantially the same extent because, as will be apparent from FIG. 16, the cavities 1 and 2 are offset from the holes 1 and 2 to substantially the same extent as the cavities 3 and 5 are offset from the holes 3 and 5. In the terminal for the cavity 4, shown in FIG. 22, which is a middle row terminal, the leg portion 114 is shorter than that of the terminal shown in FIG. 23 which is for a top row terminal. Each arm 102 in FIGS. 22 and 23 offsets the receptacle 96 from the leg 100 of respective terminals received in cavities 4 and 7 to accommodate the respective offset in holes 4 and 7 in substrate S, since the cavities 4 and 7 are offset from the holes 4 and 7. The offsets afforded by the arms 102 are, however, greater than in the case of the terminals of FIGS. 20 to 23. The terminals shown in FIGS. 24 and 25 are for the cavities 6 and 8, respectively, which are the outside cavities of the top row and the arm portions 114 in both of these figures are, therefore, of equal length. However, although the offset afforded by the arms 102 is equal to that afforded by the arms 102 in FIGS. 22 and 23, the arms 102 are longer in FIGS. 24 and 25.

Each of the terminals shown in FIGS. 18 to 25 forms part of a discrete strip of terminals joined in side by side relationship by carrier strips 120 and 122, which are primary and secondary carrier strips, respectively, and are connected by transverse strips 123. The length of each leg portion 114 is determined by the positioning of the secondary carrier strip 122 therealong.

Figure 26:
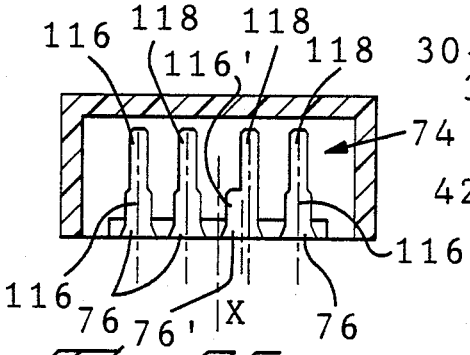
FIG. 26 is a plan view shown partly in section illustrating a modification of a detail of the connector of FIG. 1 or 2.

It will be apparent that each of the notches 76 must receive the retaining members 108 of two of the terminals 95 since the notches 76 are four in number whereas the terminals 95 are eight in number. To this end, as shown in FIG. 26 each notch 76 has a wider part 116 for receiving the retaining member 108 of one terminal 95, communicating with a narrower part 118 for receiving the retaining member 108 of another terminal 95. Where there are eight cavities 62, each of eight different terminal strips are produced as shown in FIGS. 18 to 25 respectively, each terminal is severed from its strip and, during manufacture of the connector 10, is selectively inserted into its respective cavity 62 in its proper orientation by means of a stitching machine, after the body 14 has been molded. Where there are fewer than eight cavities 62, appropriate ones of the terminals manufactured for a body 14 with eight cavities, are inserted into these fewer cavities.

A rear view of terminals 95 in body 14 is shown in FIGS. 13 and 13A. Terminals 95 that are received in the row of holes H in substrate S closer to mating face 66 are shown in FIG. 13; FIG. 13A shows terminals 95 that are received in the row of holes H more distant from mating face 66.

As shown in FIGS. 18 to 25, the skiving wings 121 of each retaining member 108 are positioned at its end nearest to the insertion lance 112.

As shown in FIG. 26, the groove 76' for the terminal shown in FIG. 23 has its wider part 116' offset from the longitudinal axis X of the groove 76' for alignment of the terminal with its hole H. As will be apparent from FIG. 23, the retaining member 108' of the terminal is unsymmetrical to allow for this.

We claim:

1. A one piece molded insulating housing for a shielded electrical connector, the housing comprising:

a circular cross-section, elongate, plug portion having at one end thereof a mating face, a plurality of terminal receiving parallel cavities, extending through said plug portion axially thereof and each having a pin receiving mouth opening into said mating face;

a substantially rectangular cross-section connector body formed integrally with the other end of the plug portion and from which projects, forwardly, a hood surrounding said plug portion in spaced relationship therewith, to allow a circular cross-section, electrical socket to be mated with said plug portion, said body having a terminal receiving face opposite to said mating face, each of said cavities extending through said body and having a terminal receiving mouth opening into said terminal receiving face, a protective skirt extending rearwardly from the periphery of said terminal receiving face and having a rear edge, each of two opposite sides of said body being formed with an external groove opening into a forward edge of said hood having a deepened part proximate to said rear edge; and a terminal leg spacer plate projecting from said terminal receiving face along one edge thereof in a direction away from said plug portion, a plurality of elongate, terminal leg receiving, spacer notches, each extending normally of said terminal receiving face and opening into an edge of said spacer plate remote from said terminal receiving face each for the retention of a terminal leg therein; and a metal shield slidable onto said body and having a flange for slidable reception in each groove and being engageable in the deepened part thereof with a snap action.

2. A housing as claimed in claim 1, wherein each of said notches is shaped for the retention of a plurality of terminal legs therein in spaced relationship lengthwise of said notch.

3. A housing as claimed in claim 2, wherein each notch has an enlarged portion extending from said edge for receiving a first terminal leg and a narrower portion between said enlarged portion and said terminal receiving face, for receiving a second terminal leg.

4. A housing as claimed in claim 1 wherein each notch defines a sidewall, said sidewall having a groove therein to receive a complementary projection on a terminal leg, whereby movement of the terminal normal to the spacer plate is prevented.

5. A housing as claimed in claim 1, wherein each of two opposite sides of said skirt is formed with a recess for receiving a detent on said shield with a snap action.

6. A housing as claimed in claim 1, wherein each of two opposite sides of said hood is formed with an external relief recess for a resilient anchoring member on said shield.

7. A surface mounted shielded electrical connector, comprising;

a one-piece, molded, substantially rectangular cross-section insulating housing having at one end a mating face and a terminal receiving face opposite thereto, a top wall and side walls, a plurality of elongate terminal receiving cavities each opening into both of said faces, a bottom mounting face for mounting the housing on a surface of a substrate, extending transversely of said mating face and said terminal receiving face, a terminal leg spacer plate projecting from said terminal receiving face in a direction away from said mating face and parallel with said mounting face, elongate, terminal leg retaining notches each extending normally of said terminal receiving face, opening into an edge of said spacer plate remote therefrom;

a one-piece metal shield enclosing said top and side walls having a front wall with an opening allowing access to said mating face, a plurality of spring fingers extending from the periphery of said opening inwardly thereof to resiliently engage the shield of a mating connector inserted through said opening; and an electrical terminal received in each cavity having an elongate mating part with a mating end proximate to said mating face and a rear end remote therefrom, an intermediate retention plate retaining the terminal in the cavity, and being connected to said rear end of the mating part, and a terminal leg connected to the retention plate by way of a cranked planar arm and extending parallel to said terminal receiving face and through a respective one of said notches, beyond said mounting face, retaining means on said terminal leg serving to retain it in said respective notch, and wherein one end of said cranked arm is connected to a rear end of said retention plate, the other end of said cranked arm being connected to said terminal leg, said cranked arm projecting from said mating face normally thereof and in substantial alignment with said mating part.

8. A connector as claimed in claim 7, wherein said retaining means of each terminal leg is substantially 'U' shaped and has skiving wings projecting therefrom which bite into opposite walls of said respective notch.

9. A connector as claimed in claim 7, wherein at least one of the notches has a wider part receiving the retaining means of one of the the terminals and a narrower part receiving the retaining means of another of the terminals, said wider part and said narrower part being laterally offset from each other.

10. A connector as claimed in claim 7, wherein said cavities are displaced from one another in a direction perpendicular to said mounting face and also transversely of such direction, the mounting legs projecting beyond said mounting face to an equal extent, and being arranged in two rows spaced from each other in the direction of said terminal receiving face.

11. A connector as claimed in claim 7, wherein said cavities are arranged in three rows displaced from each other in a direction perpendicular to said mounting face, the legs of a first plurality of said terminals being of a first length, the legs of a second plurality of said terminals being of a second length, the legs of a third plurality of the terminals being of a third length, whereby the legs project beyond said mounting face to an equal extend in two rectilinear rows spaced from each other in the direction of said terminal receiving face, the legs of each row of legs being spaced from each other, with a spacing which is different from that of the corresponding row of cavities.

12. A connector as claimed in claim 11 wherein said cranked arms of the terminals on one side of said terminal receiving face extend in the opposite direction to said cranked arms on the other side of said terminal receiving face.

13. A housing as claimed in claim 1, wherein each groove has a flange receiving mouth opening into the forward edge of said hood, said groove also opening into the rear edge of said skirt.

14. A surface mounted electrical connector, comprising:

a one-piece, molded, substantially rectangular cross-section insulating housing having at one end a mating face and a terminal receiving face opposite thereto, a top wall and side walls, a plurality of elongate terminal receiving cavities each opening into both of said faces, a bottom mounting face for mounting the housing on a surface of a substrate, extending transversely of said mating face and said terminal receiving face, a terminal leg spacer plate projecting from said terminal receiving face in a direction away from said mating face and parallel with said mounting face, elongate, terminal leg retaining notches each extending normally of said terminal receiving face, opening into an edge of said spacer plate remove therefrom, the cavities being arranged in rows displaced from each other in a direction perpendicular to said mounting face; and an electrical terminal received in each cavity, at least one of said terminals having an elongate mating part with a mating end proximate to said mating face and a rear end remote therefrom, a retention plate connected at one end to the rear end of the mating part and being connected at an opposite end to one end of an arm which is cranked towards one of the side walls of the housing, a terminal leg connected to the other end of said cranked arm, extending therefrom and through a respective one of said notches, whereby at least one of said notches is offset toward a side wall from the respective terminal receiving cavity and the cranked arm makes the transition between the mating part and the terminal leg.

15. A one-piece dielectric housing for an electrical connector, comprising:

an elongate circular cross-section plug portion having at one end thereof a mating face, a plurality of terminal receiving cavities extending axially through said plug portion, each cavity having a pin receiving mouth opening onto said mating face;

a substantially rectangular cross-section connector body formed integrally with the other end of the plug portion and from which projects forwardly a hood surrounding said plug portion in spaced relationship therewith, said hood adapted to allow a circular cross-section electrical socket to be mated with said plug portion, said body defining side walls and having a terminal receiving face opposite to said mating face, each of said cavities extending through said body and having a terminal receiving mouth opening onto said terminal receiving face; and a terminal leg spacer plate extending from one edge of said terminal receiving face away from said plug portion, said terminal leg spacer plate having a plurality of elongate terminal leg receiving channels extending normally of said terminal receiving face and opening onto an edge of said spacer plate remote from said terminal receiving face, said housing adapted to receive terminals with each terminal having a mating portion received in a terminal receiving cavity and a terminal leg received in a corresponding channel, at least one of the channels offset toward a side wall from the corresponding terminal receiving cavity.

16. A housing as recited in claim 15 wherein the spacer plate provides means adapted to cooperate with a terminal leg for preventing a terminal leg received in a channel from moving normal to said spacer plate.

17. A housing as recited in claim 15 wherein each channel has an enlarged portion extending from said edge for receiving a first terminal leg and a narrower portion between said enlarged portion and said terminal receiving face for receiving a second terminal leg.

* * * * *